United States Patent [19]

Kulesza et al.

[11] Patent Number: 4,669,997

[45] Date of Patent: Jun. 2, 1987

[54] PNEUMATIC ACTION TOY CREATURES

[75] Inventors: Ralph J. Kulesza, Chicago; Harry Disko, South Barrington; Dennis R. Gibbons, Hometown, all of Ill.

[73] Assignee: Marvin Glass & Associates, Chicago, Ill.

[21] Appl. No.: 698,079

[22] Filed: Feb. 4, 1985

[51] Int. Cl.[4] ..... A63H 3/06

[52] U.S. Cl. ..... 446/183; 446/199; 446/304; 446/337

[58] Field of Search ..... 446/183, 185, 180, 198, 446/184, 197, 176, 330, 337, 339, 359, 395, 340

[56] References Cited

U.S. PATENT DOCUMENTS

| | | | |
|---|---|---|---|
| 737,337 | 8/1903 | Cairns | 446/198 |
| 1,324,646 | 12/1919 | Clements | 446/183 |
| 1,859,268 | 5/1932 | Larson | 446/198 X |
| 1,916,988 | 7/1933 | Pieschke | 446/180 X |
| 2,854,788 | 10/1958 | Baggott | 446/183 |
| 3,577,676 | 5/1971 | Powell | 446/183 |
| 3,599,363 | 8/1971 | Baginski | 446/197 |
| 4,217,725 | 8/1980 | Sapkus et al. | 446/183 |
| 4,262,444 | 4/1981 | Cooper et al. | 446/185 |
| 4,307,533 | 12/1981 | Sims et al. | 446/365 X |

FOREIGN PATENT DOCUMENTS

| | | | |
|---|---|---|---|
| 714151 | 8/1954 | United Kingdom | 446/185 |

*Primary Examiner*—Mickey Yu

*Attorney, Agent, or Firm*—John S. Pacocha

[57] ABSTRACT

Pneumatic action toy creatures each have a body with a hollow resilient compressible portion. An opening in the compressible portion receives an elongated piston with a cross section substantially conforming to the opening to provide for pneumatic reciprocation of the piston. At least one set of opposed members is mounted for pivotal movement with respect to each other in a direction, and about an axis, generally transverse to the elongated dimension of the piston. Either by an enlargement on one end of the piston, or through interaction with the opposed members, the throw of the piston is limited to retain the one end within the compressible portion. Reciprocation of the piston upon compression and release of the resilient body portion actuates pivotal movement of the opposed members through mechanical engagement.

6 Claims, 20 Drawing Figures

PNEUMATIC ACTION TOY CREATURES

BACKGROUND OF THE INVENTION

1. Field of the Invention

This invention relates generally to toy creatures and more particularly to toy creatures having a pneumatic action feature.

2. Background Art

Toy creatures, particularly those that are seemingly quiescent but may be rapidly transformed into an aggressor are popular playthings. Thus, for ,example, toy frogs are disclosed in U.S. Pat. Nos. 3,353,823 and 3,577,676 which have a rapidly extendable tongue. In the toys disclosed in those Patents, the tongue is an elongated flexible element that is projected out through a capillary opening upon squeezing the resilient hollow body of the toy. U.S. Pat. Nos. 4,244,138 and 4,307,533 disclose a bird and an insect, respectively, with biased closed opposed members that are openable by pushing on a trigger lever. However, there remains a need for pneumatic action toy creatures that provide novel and entertaining actions.

SUMMARY OF THE INVENTION

The present invention is concerned with providing pneumatic action toy creatures that are rapidly transformable from a seemingly quiescent state into an aggressive one. This and other objects and advantages of the invention are achieved by providing a creature having a body with a hollow, resilient compressible portion that is generally airtight and which has an opening of a predetermined cross section. An elongated reciprocating piston of a cross section that permits reciprocation of the piston in the opening, but maintains the portion relatively airtight, is carried by the body with one end retained in the compressible portion. Opposed members are pivotably moveable with respect to each other in a direction transverse to the elongated dimension of the piston about an axis that is also substantially transverse to the elongated dimension of the piston. Compressing the portion ejects the piston with the free end of the piston actuating pivotal movement of the opposed members and upon release of the portion the piston returns to its retracted position substantially within the body and the opposed members return to their prior positions.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
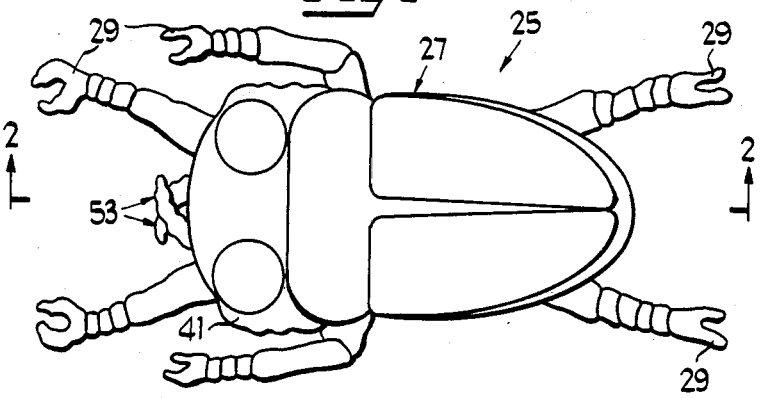
FIG. 1 is a top plan view of the one embodiment of the present invention.
Figure 3:
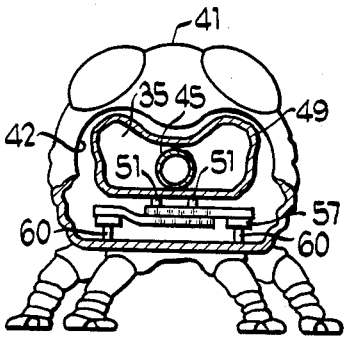
FIG. 3 is a sectional view taken generally along line 3—3 of FIG. 2.

Referring now to the drawings in which like parts are designated by like reference numerals throughout the several views there is shown in FIG. 1 a toy creature 25 having a body 27. A number of legs 29, emanating from a central undercarriage 30 are attached to body 27 by adhesives or other suitable fasteners. Legs 29 are integrally formed with undercarriage 30 and maintain the body spaced from a generally planar playing surface.

Body 27 includes a hollow, resilient, compressible, bulbous tail portion 31 of a material such as vinyl. At its forward end, tail bulb 31 has an annular groove 33 adjacent the periphery of a front wall 35. The front wall includes a generally centrally disposed, forwardly extending, collar 37 through which there is a circular bore 39.

Also forming a part of body 27 is a front or head portion 41 that may be formed of a relatively rigid material such as polystyrene, or a more resilient material such as polyethylene. At the front, head 41 has a mouth opening 42. The back end of the head has an inwardly turned flange 43, the edge of which defines an aperture 44.

Figure 2:
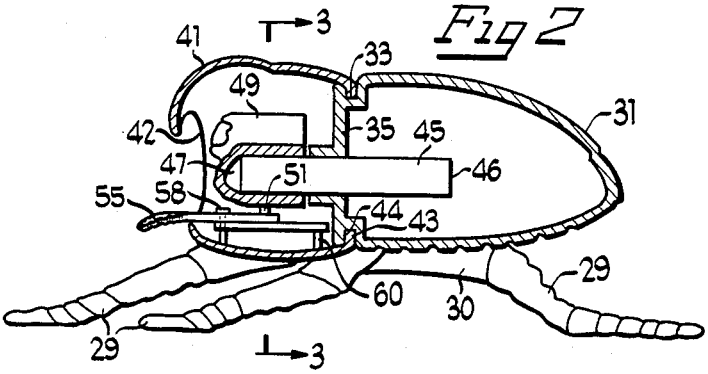
FIG. 2 is a sectional view taken generally along line 2—2 of FIG. 1.
Figure 4:
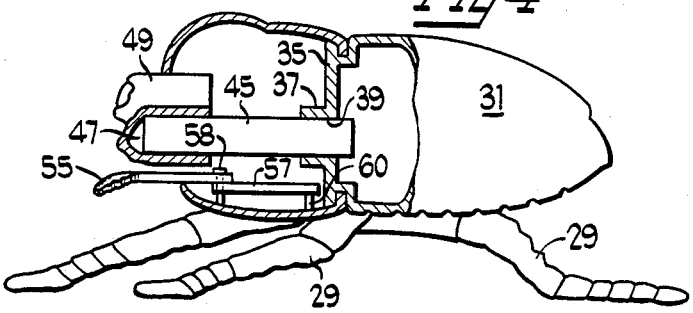
FIG. 4 is a partial sectional view along a line similar to line 2—2 of FIG. 1 but showing the actuated state.
Figure 6:
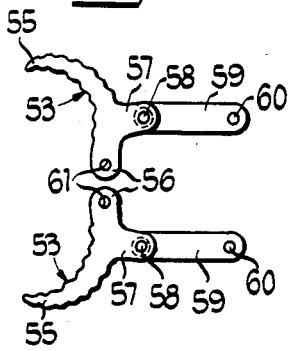
FIG. 6 is a top plan view of the opposed members open.
Figure 5:
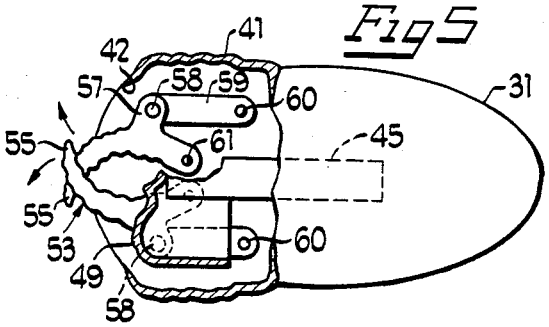
FIG. 5 is a partial top plan view with a portion of the body broken away to show the mechanism.
Figure 7:
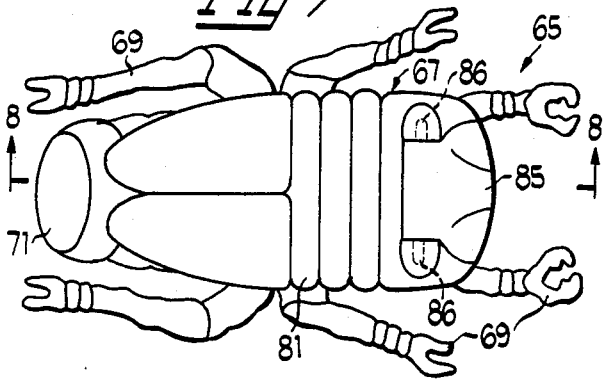
FIG. 7 is a top plan view of an alternative embodiment of the present invention.
Figure 11:
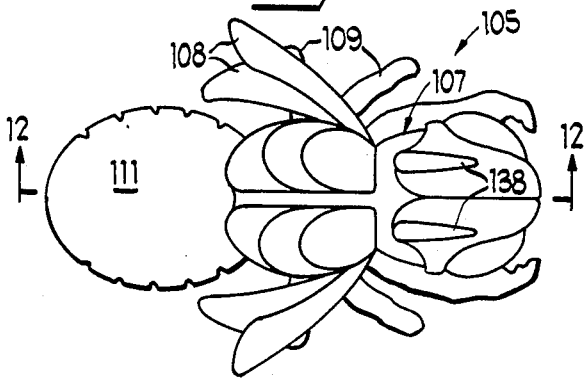
FIG. 11 is a top plan view of another alternative embodiment of the present invention.
Figure 8:
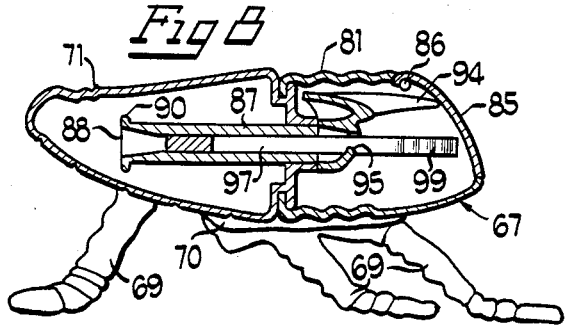
FIG. 8 is a sectional view taken generally along line 8—8 of FIG. 7.
Figure 12:
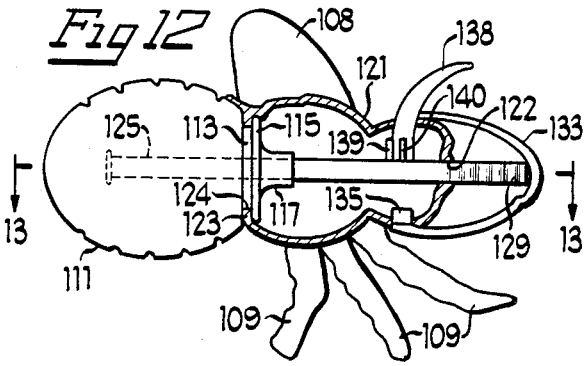
FIG. 12 is a sectional view taken generally along line 12—12 of FIG. 11.
Figure 9:
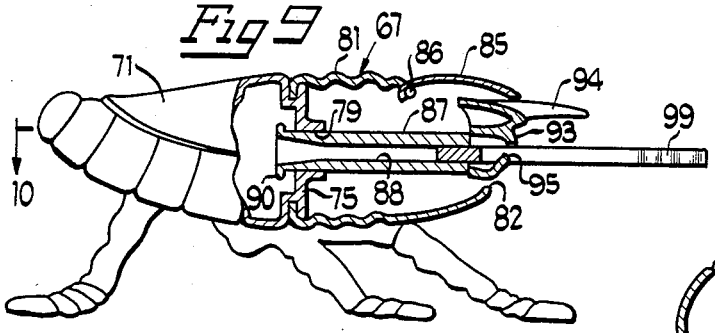
FIG. 9 is a side elevational view with a portion of the body broken away.

Resilient portion 31 is attached to head 41 by forcing the front of the resilient portion into opening 44 until flange 43 engages annular groove 33 to retain the two sections together. Thus as shown in FIGS. 2 and 4, compressible tail section 31 is attached to head section 41 with the front wall 35 and collar 37 within the hollow portion of the head.

Received in bore 39 for reciprocating movement along the axis of the bore is an elongated piston 45 with opposed rearward and forward ends 46 and 47, respectively. Secured to the forward end of the piston for movement with the piston is a tongue actuator piece 49. Two spaced apart pins 51 depend from the bottom of piece 49. Carried by head 41 for pivotal movement toward and away from each other in a direction transverse to the axis of piston 45 are a pair of pincers 53.

The outer end 55 of each of the pincers is styled compatible with the overall styling of creature 25. Adjacent the other end, the pincer bifurcates into generally transverse arms 56 and 57. Arm 57 is attached for pivotal movement by a pin 58 to a link 59 that is secured within head 41 on pins 58 and 60. An aperture 61 is provided adjacent the end of arm 56 which receives pin 51 depending from actuator piece 49.

When bulbous tail portion 31 is compressed by squeezing, piston 45 is pneumatically ejected carrying forward and exposing actuator tongue 49 through mouth opening 42. Depending pins 51 pivot open the toggle-jointed pincers 53. Upon release, resilient portion 31 returns to its uncompressed state retracting piston 45 along with the actuator tongue and closes pincers 53. The limited forward movement of arms 56 of toggle-jointed pincers 53 restrain the forward movement of piston 45 so as to retain piston end 6 within tail 31.

In the alternative embodiment shown in FIGS. 7–10, a creature 65 is provided with a body 67 similar to, but styled differently than, body 27. A plurality of legs 69 extending out of an integrally formed generally central undercarriage 70 are attached to body 67. Hollow resilient tail portion 71 has an annular groove 73, forward wall 75, and a collar 77 with a bore 79 generally similar to, but of a different configuration than, tail portion 31. Head 81 has a forward opening 82 and an inwardly directed flange 83 at the bnack end defining an aperture 84.

As with the previous embodiment, a forward part of the tail portion is inserted into aperture 84 and is attached to the head section by engagement of flange 83 in groove 73. Attached for pivotal movement adjacent the front of head 81 is a flap 85 conforming to mouth opening 82. Flap 85 has a pair of integrally formed, opposed pins 86 that are journaled under head 81 adajacent opening 82 permitting up and down pivotal movement of the flap about the axis of the opposed pins. In the quiescent state, gravity biases the flap to close the mouth opening.

Figure 10:
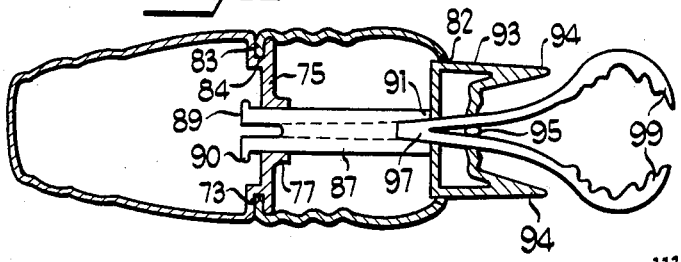
FIG. 10 is a sectional view taken along line 10-10 of FIG. 9.

A tubular piston 87 has an outer diameter conforming with bore 79 permitting reciprocal movement of piston 87 substantially along its elongated axis in response to compression and release of tail 71. Extending through piston 87 is a bore 88. As is best shown in FIG. 10, the inside end 89 of piston 87 has an enlarged rim 90 which prevents the piston from being fully ejected from the tail by pneumatic action. At its forward end 91, piston 87 carries a tongue actuator piece 93 with a pair of spaced apart forward fang projections 94 which cam against the inside surface of flap 85 to pivot it upwardly as piston 87 is pushed forwardly upon compression of tail 71. Projecting upwardly from the center of the lower portion of piece 93 is a single tooth 95.

Forward piston end 91 also carries a bifurcated jaw 97. The back end of the jaw is inserted through actuator piece 91 and secured to the forward end of the piston with the single tooth 95 positioned between split-apart front mandibles 99. Jaw 97 is made of a relatively resilient plastic such as polyethylene or polypropylene so that the inherently biased mandibles may be cammed apart when jaw 97 is in the extended position shown in FIG. 10. At the same time that piston 87 is extended by pneumatic action, the jaw is also ejected past the single tooth 95 which is stationary with respect to piston 87 and cams open mandibles 99. When piston 87 is retracted, open mandibles 99 compress to permit jaw piece 97 to go back inside bore 88 and flap 85 drops to close mouth opening 82.

FIGS. 11–15 show another alternative of the present invention embodied in a creature 105. A body 107 includes simulated wings 108 and a plurality of legs 109 integrally formed together and attached to body 107. As in the previous embodiment, creature 105 is provided with a bulbous tail portion 111 having an annular groove 113, forward wall 115, forwardly extending collar 117 and a bore 119. Secured to tail 111 is a head section 121 with a front opening 122 and an inwardly directed rear flange 123 defining an aperture 124. The forward portion of the tail is inserted within the opening 124 and retained by engagement of flange 123 in annular groove 113.

Figure 14:
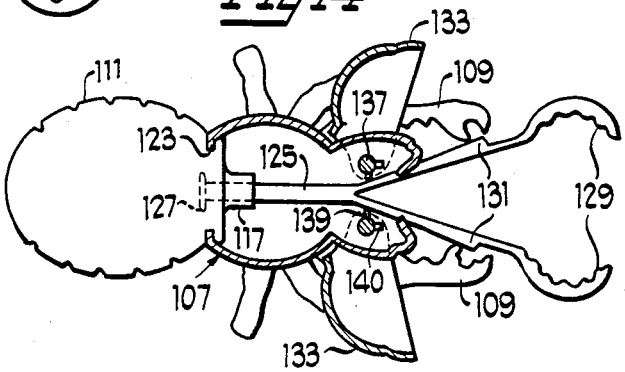
FIG. 14 is a top plan view with a portion of the body broken away to shown the mechanism in the aggressive state.
Figure 15:
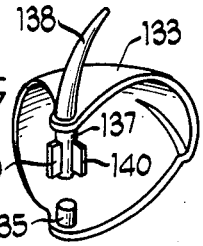
FIG. 15 is a perspective view of an opposed member of the embodiment shown in FIG. 11.
Figure 16:
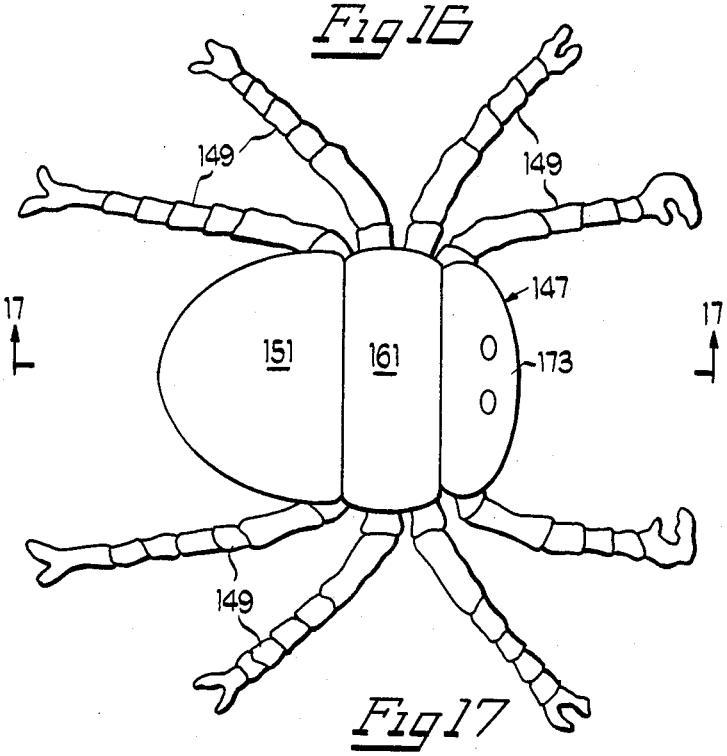
FIG. 16 is a top plan view of yet another alternative embodiment of the present invention.
Figure 18:
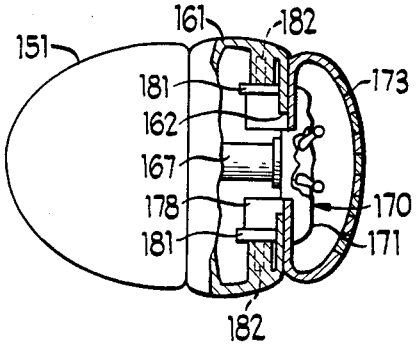
FIG. 18 is a partial top plan view with a portion of the body broken away to show the mechanism.

An elongated split piston 125 is carried in the bore 119 for reciprocating movement upon compression and release of tail 111. The end of piston 125 in tail 111 has a rim 127 that is larger than bore 119 to retain that end of the piston inside the tail and provide a larger surface area. From approximately its midpoint, piston 125 is bifurcated and the forward end forms a set of mandibles 129. Intermediate the forward mandibles and the retained end, the piston has a pair of laterally projecting barbs 131. Piston 125 is made of a material sufficiently resilient so that the mandibles are biased open as shown in FIG. 14 when extended out of body 107. As piston 125 is propelled forwardly, mandibles 129 pivot open by their inherent bias in a direction, and about an axis, transverse to the elongated dimension of the piston.

Body 107 also carries a pair of lateral mouth closing cheeks 133. Each cheek has a set of inwardly directed lower and upper spindles 135 and 137, respectively, which fit into mating apertures in the head section 121. Accordingly, the opposed cheeks are mounted for pivotal movement about the axis of the pins in a direction transverse to the elongated dimension of piston 125. An upward extension of spindle 137 is conveniently formed in a representation of an antennae 138.

Figure 13:
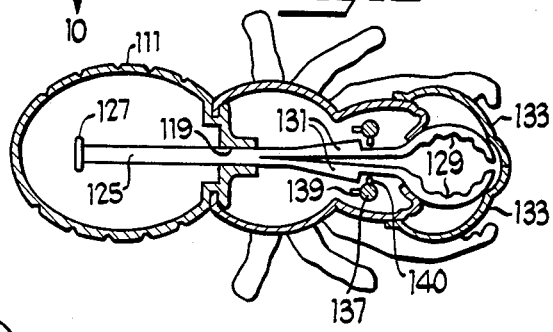
FIG. 13 is a sectional view taken generally along line 13—13 of FIG. 12.

Substantially at right angles, a pair of tabs 139 and 140 project laterally toward the tail and piston, respectively. As is illustrated in FIG. 13, in the quiescent state, tabs 140 are forward of barb 131. When piston 125 is propelled forwardly by pneumatic action upon compression of tail 111, each barb 131 engages a tab 140 to pivot the opposed cheeks 133 apart into an open position. In the pivoted apart open position, tabs 139 have been rotated approximately ninety degrees to now extend toward the axis of the piston. Accordingly, when the piston is retracted upon release of the compressed tail, the back of each barb 131 engages a respective tab 139 to pivot the opposed cheeks back together and close about the retracted mandibles 129.

Yet another creature 145, embodying another alternative of the present invention, is shown in FIGS. 16–20. Creature 145 has a body 147 supported upon a plurality of legs 149 integrally formed with a generally central undercarriage 150 that is attached to the body. The rear of the body is formed by a bulbous tail portion 151 similar to the tail portions of the previous embodiments and having an annular groove 153, front wall 155, forwardly extending collar 157 and bore 159.

Head section 161 has a forwardly disposed opening 162 and an inwardly directed rear flange 163 defining an aperture 164 that conforms with the annular groove 153 of the tail. Accordingly, the front part of the resilient tail may be compressed and inserted into the back end of the head section 161 through aperture 16. and then be retained by the engagement of flange 163 in annular groove 153. On the inside, body section 161 has a pair of inwardly extending, upper and lower sets of spaced-apart, apertured bosses 165.

An elongated piston 167, having a cross section substantially conforming to the cross section of bore 159 so as to permit reciprocal movement of the piston upon contraction and release of the tail 151, is received in and carried by bore 159. Piston 167 has a rearward end 168 within tail 151 and a forward projecting end 169. Attached to the forward end 169 is a tongue actuator piece 170 that reciprocates with the piston. Tongue actuator 170 is formed with forward and rearward cam surfaces 171 and 172, respectively.

Figure 17:
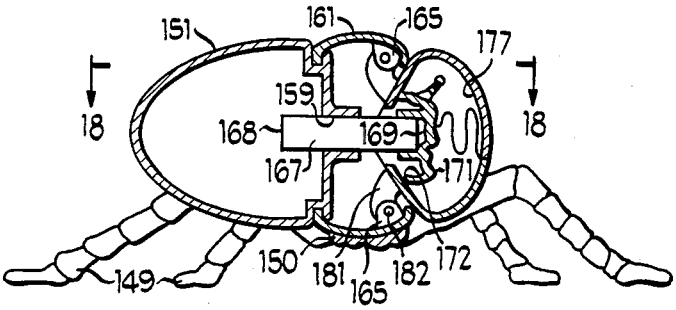
FIG. 17 is a sectional view taken generally along line 17—17 of FIG. 16.
Figure 19:
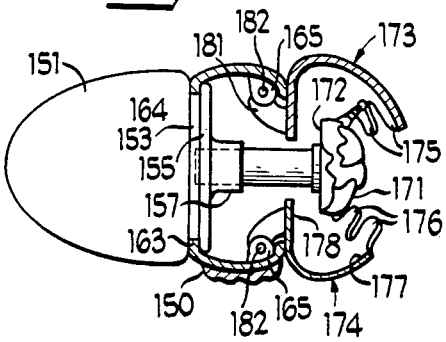
FIG. 19 is a partial sectional view taken along a line similar to line 17—17 of FIG. 16 showing the embodiment in the actuated aggressive state.
Figure 20:
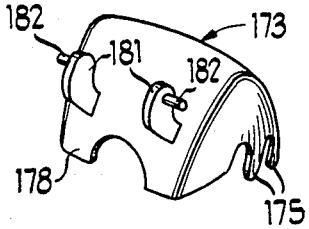
FIG. 20 is a perspective view of an opposed member of the embodiment of FIG. 16.

Top and bottom opposed jaw members 173 and 174, respectively, are attached to head section 161 adjacent the opening 162 for pivotal movement between a closed mouth position and an open mouth position. Upper and lower members 173 and 174 differ in that their respective spaced apart teeth 175 and 176 are offset with respect to each other so that they mesh or intertwine when the jaw members are closed together as illustrated in FIG. 17. Otherwise, members 173 and 174 are similar in that they each have an angled front wall 177 and an angled rear wall 178. Extending rearwardly from, and integrally formed with the rearward wall 178 are spaced apart tabs 181. Projecting outwardly to the side of each of the tabs 181 is a pin 182 having an axis transverse to the axis of piston 167. Each pin 182 is journaled in a respective apertured boss 165. Accordingly, opposed jaw members 173 and 174 freely pivot about the axis of pins 182 to open and close in a direction transverse to the axis of piston 167.

When resilient tail 151 is squeezed, piston 167 moves forwardly with forward surfaces 171 of actuator 169 engaging front angled walls 177 to cam open jaws 173 and 174. Upon release of the compressed tail, the piston is retracted with rear cam surfaces 172 engaging rear angled walls 178 to close the jaw members. The extent to which jaws 173 and 174 will open is limited by the pivotal mount. Accordingly, engagement of actuator piece 169 with angled front walls 177 of the open jaw members limits the extent of forward movement of the piston retaining end 168 within the tail portion.

While particular embodiments of the present invention have been shown and described, further changes and modifications will occur to those skilled in the art. It is intended in the appended claims to cover all such changes and modifications as fall within the true spirit and scope of the present invention.

What is claimed as new and desired to be secured by Letters Patent is:

1. A pneumatic action toy creature comprising:

a body;

a hollow, resilient compressible portion forming part of the body;

the compressible portion being generally airtight except for an opening of a predetermined cross section;

an elongated piston having opposed ends and having a cross section to fit in the opening for reciprocating movement along the elongated dimension while substantially maintaining the portion airtight;

means retaining one end of the piston in the compressible portion;

a set of opposed members carried by the piston and mounted for pivotal movement with respect to each other in a direction, and about an axis, substantially transverse to the elongated dimension of the piston;

the piston being tubular and the opposed members carried by the piston reciprocating within the tubular piston upon compression and release of the body portion; and means effecting engagement between the other end of the piston and the opposed members to actuate pivotal movement of the opposed members upon reciprocation of the piston by compression and release of the body portion.

2. The pneumatic action toy creature of claim 1 including means carried by the piston for effecting pivotal movement of the opposed members carried by the tubular piston upon compression of the body portion.

3. A pneumatic action toy creature comprising:

a body;

a hollow, resilient compressible portion forming part of the body;

the compressible portion being generally airtight except for an opening of a predetermined cross section;

an elongated piston having opposed ends and having a cross section to fit in the opening for reciprocating movement along the elongated dimension while substantially maintaining the portion airtight;

means retaining one end of the piston in the compressible portion;

a set of opposed members carried by the piston and mounted for pivotal movement with respect to each other in a direction, and about an axis, substantially transverse to the elongated dimension of the piston;

the body carrying another set of opposed members for pivotal movement with respect to each other in a direction, and about an axis, substantially transverse to the elongated dimension of the piston; and means effecting engagement between the other end of the piston and the opposed members to actuate pivotal movement of the opposed members upon reciprocation of the piston by compression and release of the body portion.

4. The pneumatic action toy creature of claim 3 in which the means effecting engagement between the other end of the piston and the other set of opposed members carried by the body is the set of opposed members carried by the piston.

5. A pneumatic action toy creature comprising:

a body;

a hollow, resilient compressible portion forming part of the body;

the compressible portion being generally airtight except for an opening of a predetermined cross section;

an elongated piston having opposed ends and having a cross section to fit in the opening for reciprocating movement along the elongated dimension while substantially maintaining the portion airtight;

means retaining one end of the piston in the compressible portion;

a set of opposed members carried by the piston and mounted for pivotal movement with respect to each other in a direction, and about an axis, substantially transverse to the elongated dimension of the piston;

means effecting engagement between the other end of the piston and the opposed members to actuate pivotal movement of the opposed members upon reciprocation of the piston by compression and release of the body portion;

a piece mounted for pivotal movement on the body in a direction, and about an axis, transverse to the elongated dimension of the piston;

the piece having a surface; and cam means carried by the piston engaging the surface to pivot the piece.

6. A pneumatic action toy creature comprising:

a body;

a hollow, resilient compressible portion forming part of the body;

the compressible portion being generally airtight except for an opening of a predetermined cross section;

an elongated piston having opposed ends and having a cross section to fit in the opening for reciprocating movement along the elongated dimension while substantially maintaining the portion airtight;

means retaining one end of the piston in the compressible portion;

a set of opposed members mounted for pivotal movement with respect to each other in a direction, and about an axis, substantially transverse to the elongated dimension of the piston;

means effecting engagement between the other end of the piston and the opposed members to actuate pivotal movement of the opposed members upon reciprocation of the piston by compression and release of the body portion;

cam means on the piston engaging the opposed members to pivotally move the opposed members between opened and closed positions;

the opposed members being mounted for pivotal movement about spindles carried by the body;

a pair of substantially transverse tabs extending from, and being secured for movement with each spindle; and the cam means on the piston engaging one of the tabs to effect opening of the members and the other tab to effect closing.

* * * * *